US008333253B2

(12) United States Patent
Radif et al.

(10) Patent No.: US 8,333,253 B2
(45) Date of Patent: Dec. 18, 2012

(54) SECTOR DIVIDED TWO-WAY OUTLET FLOW DEFLECTOR UNIT FOR A PNEUMATIC POWER TOOL

(75) Inventors: Nabil Khalil Radif, Stockholm (SE); Kristian Karl Henrik Lang, Huddinge (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 201 days.

(21) Appl. No.: 12/227,270

(22) PCT Filed: May 16, 2007

(86) PCT No.: PCT/SE2007/000473

§ 371 (c)(1),
(2), (4) Date: Dec. 29, 2008

(87) PCT Pub. No.: WO2007/133152

PCT Pub. Date: Nov. 22, 2007

(65) Prior Publication Data

US 2009/0100836 A1 Apr. 23, 2009

(30) Foreign Application Priority Data

May 17, 2006 (SE) ..... 6061099-5

(51) Int. Cl.

| | |
|---|---|
| ***B23B 45/04*** | (2006.01) |
| ***B27C 3/08*** | (2006.01) |
| ***E21B 3/00*** | (2006.01) |
| ***E21B 17/22*** | (2006.01) |
| ***E21B 19/16*** | (2006.01) |
| ***E21B 19/18*** | (2006.01) |
| ***B25C 1/04*** | (2006.01) |
| ***B25C 5/02*** | (2006.01) |
| ***B25C 5/06*** | (2006.01) |

(52) U.S. Cl. ..... 173/218; 173/168; 227/130

(58) Field of Classification Search ..... 227/130; 173/197, 219, 168–169, 211; 137/625.47; 418/270

See application file for complete search history.

(56) References Cited

U.S. PATENT DOCUMENTS

| | | | | |
|---|---|---|---|---|
| 3,472,323 | A * | 10/1969 | Hall | 173/221 |
| 3,802,538 | A * | 4/1974 | Brown | 181/230 |
| 4,244,442 | A | 1/1981 | Scarton et al. | |
| 4,822,264 | A | 4/1989 | Kettner | |
| 5,377,769 | A | 1/1995 | Hasuo et al. | |
| 5,383,771 | A * | 1/1995 | Ghode et al. | 418/15 |

(Continued)

FOREIGN PATENT DOCUMENTS

WO WO 00/47872 A1 8/2000

*Primary Examiner* — Robert Long
(74) *Attorney, Agent, or Firm* — Holtz, Holtz, Goodman & Chick, PC

(57) ABSTRACT

An outlet flow deflector unit for a pneumatic power tool having a housing with an outlet opening, comprises a cup-shaped rotatable deflector element communicating with the outlet opening and having at least one axially directed opening and one radially directed opening located within a certain angular interval of the deflector element circumference, and a stationary cup-shaped sector element located inside the deflector element and having radial opening locating in a certain angular sector substantially larger than the angular interval of the deflector element opening, and an axially directed outlet port, wherein the deflector element is rotatable to obtain alignment either between the radial openings for a radially directed outlet flow, or between the axial opening and the outlet port for accomplishing an axially directed outlet flow.

2 Claims, 1 Drawing Sheet

U.S. PATENT DOCUMENTS

| | | | | |
|---|---|---|---|---|
| 5,423,350 | A | 6/1995 | Zinck | |
| 5,591,070 | A * | 1/1997 | Kachich | 451/295 |
| 5,992,539 | A | 11/1999 | Lin | |
| 6,082,986 | A * | 7/2000 | Seward et al. | 418/270 |
| 6,089,436 | A * | 7/2000 | Ho et al. | 227/130 |
| 6,158,528 | A * | 12/2000 | Izumisawa | 173/168 |
| 6,199,383 | B1 | 3/2001 | Pusateri | |
| 6,296,168 | B1 * | 10/2001 | Hung | 227/130 |
| RE39,009 | E * | 3/2006 | Izumisawa | 173/168 |
| 7,398,836 | B2 * | 7/2008 | Elmvist et al. | 173/218 |
| 2006/0225905 | A1 * | 10/2006 | Elmvist et al. | 173/197 |
| 2008/0023520 | A1 * | 1/2008 | Marshall et al. | 227/130 |
| 2008/0093411 | A1 * | 4/2008 | Chang | 227/130 |

* cited by examiner

SECTOR DIVIDED TWO-WAY OUTLET FLOW DEFLECTOR UNIT FOR A PNEUMATIC POWER TOOL

This application is a U.S. National Phase Application under 35 USC 371 of International Application PCT/SE2007/000473 filed May 16, 2007.

The invention relates to an outlet flow deflector for a pneumatic power tool, wherein the flow of outlet air from the tool easily can be given different directions, either axially in the longitudinal direction of the tool housing or radially, as desired by the tool operator.

The problem to be solved by the invention is to create a simple and non-expensive shiftable outlet deflector by which the operator in a simple manner can choose the flow direction of the outlet air, thereby obtaining as little disturbance as possible by the outlet air flow during work.

A previous solution to this problem is described in WO 2004/065070. This previous outlet deflector design, however, is relatively complicated regarding both structural design and operation. It contains a number of details and requires a combined axial displacement and rotation for shifting between axial and radial direction of the outlet flow.

The object of the invention is to create an outlet deflector unit for a pneumatic power tool which is shiftable between a radial and axial flow direction and by which the number of comprised details and hence the manufacturing costs are reduced and the operation is simplified.

Further objects and advantages by the invention will appear from the following specification and claims.

A preferred embodiment of the invention is described below with reference to the accompanying drawing.

In the drawings

Figure 1:
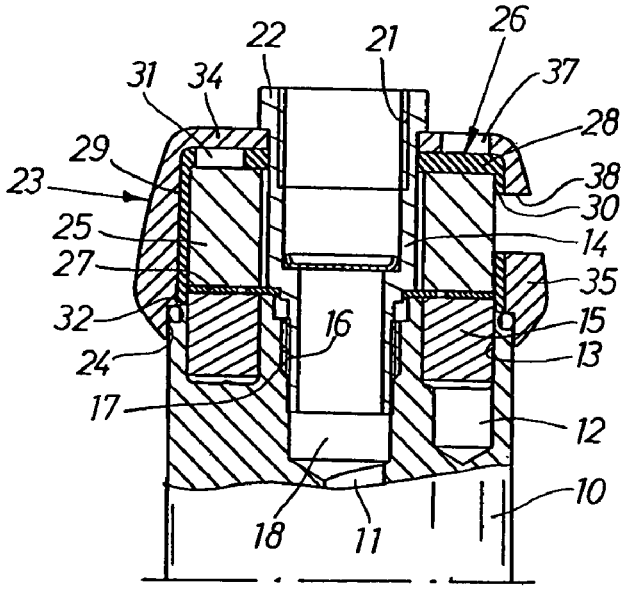
FIG. 1 shows a longitudinal section through an outlet deflector unit according to the invention.
Figure 3:
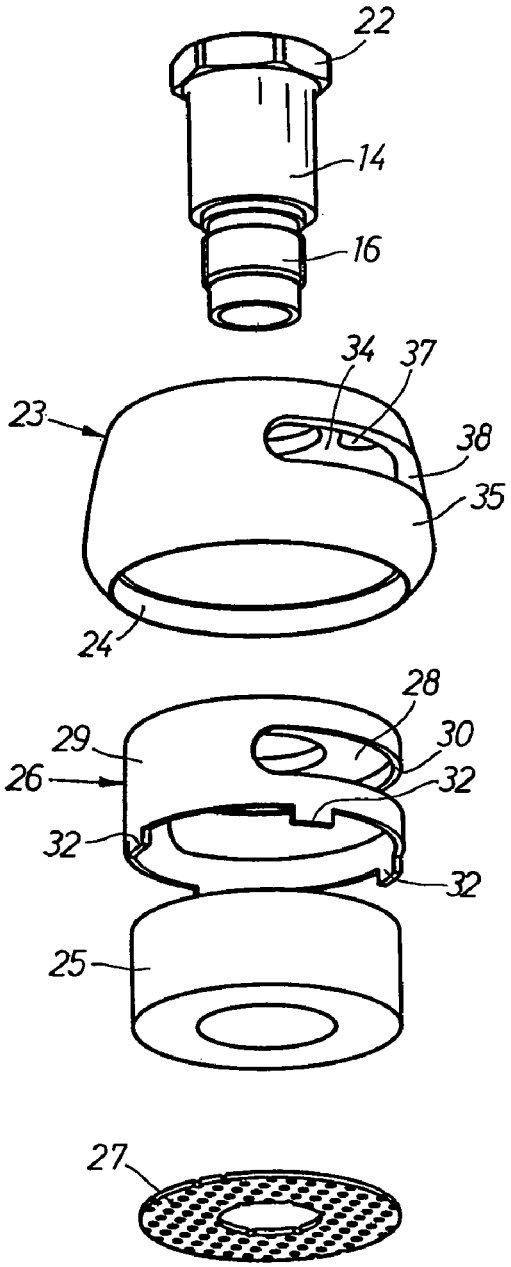
FIG. 3 shows an exploded view of the outlet deflector unit in FIGS. 1 and 2.
Figure 2:
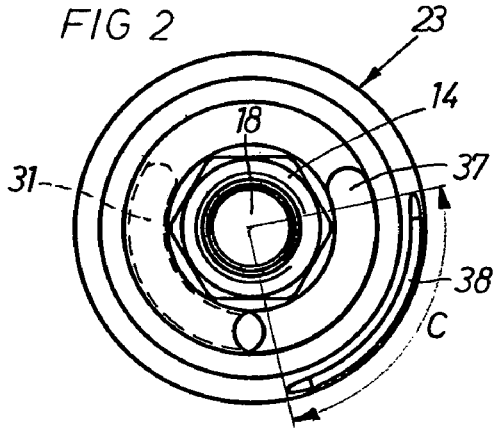
FIG. 2 shows an end view of the outlet deflector unit in FIG. 1.
Figure 4:
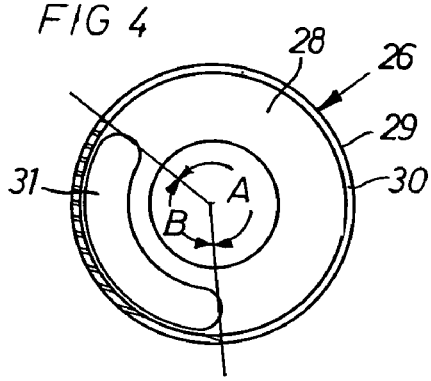
FIG. 4 shows a cross section of the sector element illustrating the angular sectors of the radial and axial outlet openings.

The outlet deflector unit according to the invention is intended to be applied on a pneumatic power tool, in particular a manually supported power tool, a power tool comprising a cylindrical housing 10, a motor (not shown), a pressure air inlet passage 11 and an outlet passage 12 with a ring shaped outlet opening 13 at the rear end of the housing 10. The outlet opening 13 is fitted with a noise damping filter element 15, and the deflector is arranged to receive and redirect the outlet air flow leaving the motor via the outlet opening 13 and filter element 15. The deflector is attached to the tool housing 10 by a tubular retaining socket 14 having a threaded portion 16 for engagement with a corresponding thread 17 in a bore 18 forming a part of the inlet passage 11. Accordingly, the retaining socket 14 is a part of the pressure air inlet passage and functions as a connection member for a pressure air conduit. For receiving and securing a connection piece of a pressure air conduit the socket 14 is formed with an internal thread 21. At its outer end the retaining socket 14 is formed with a radial hexagonal collar 22 to be engaged by a spanner at mounting of the socket 14 at the tool housing 10.

The deflector comprises a cup-shaped deflector element 23 which is axially confined between the collar 22 and the tool housing 10. At its open end the deflector element 23 has a rim portion with a peripheral groove 24 forming a radial guide and seal relative to the rear end of the tool housing 10. Since the deflector element 23 covers the entire rear end of the tool housing 10 and, hence the circular outlet opening 13 the exhaust air leaving the tool housing 10 has to pass through the deflector. Moreover, the outlet deflector comprises a noise damping filter element 25, a sector element 26 and a perforated screen 27. The latter is intended to separate the two filter elements 15 and 25 and to form a flow restriction to improve the noise damping. The sector element 26 is rotationally locked relative to the tool housing 10 via four teeth 32 engaging mating non-illustrated grooves in the housing 10, whereas the deflector element 23 is freely rotatable in relation to the housing 10 and the retaining socket 14. The deflector parts are kept together axially by being confined between the tool housing 10 and the collar 22 of the retaining socket 14.

Like the deflector element 23, the sector element 26 is cup-shaped with an open end facing the tool housing 10 and the outlet opening 13, a rear end wall 28, and a peripheral side wall 29. In the side wall 29 there is provided a peripheral slot 30 extending over a certain angular sector A of about 240 degrees, and in the rear end wall 28 there is a banana-shaped outlet port 31 extending over an angular sector B of about 120 degrees. However, the sector B for the outlet port 31 does not coincide with or overlap the sector A of the slot 30.

The deflector element 23 has a rear end wall 34 and a peripheral side wall 35, wherein the end wall 34 has a central opening 36 for the retaining socket 14 and a banana-shaped opening 37, whereas the side wall 35 is provided with a peripheral opening 38. The openings 37 and 38 are located within substantially the same angular interval, wherein banana-shaped opening 37 covers an angle of about 120 degrees and the peripheral opening 38 extends over an angular interval C of about 90 degrees. It is to be observed that the angular interval covered by the opening 38 is much smaller than the angular sector A covered by the slot 30 of the sector element 26.

The function of the above described deflector unit is to accomplish a choice of flow direction of the outlet air leaving the tool just by manually rotating the deflector element 23. In order to obtain a rearwardly directed outlet flow the deflector element 23 is rotated to a position where the banana-shaped opening 37 coincides with the banana-shaped opening 31 in the sector element 26. In that position the peripheral slot 30 of the sector element 26 does not coincide with the peripheral opening 38 in the deflector element but is covered and closed by the side wall 35 of the deflector element 23.

A radially directed outlet flow is obtained by rotating the deflector element 23 to a position where the opening 38 coincides with the slot 30 of the sector element 26 and, at the same time, the banana-shaped outlet port 31 of the sector element 26 is covered and closed by the end wall 34 of the deflector element 23. Since the slot 30 has about the double angular extent compared to the opening 38 the deflector element 23 can be rotated within an angular interval of about 120 degrees to vary the radial direction of the outlet flow, whereas the outlet port 31 and the opening 37 are still out of alignment.

There are no specifically distinguished angular positions or movement restrictions provided for the deflector element 23 which means that a number of intermediate positions could be obtained where the outlet flow is partly directed rearwardly from the tool housing 10 and partly radially.

The most significant feature of the deflector unit according to the invention is the simplicity in both design and handling. It contains a few parts and is maneuvered just by rotating the deflector element 23 to obtain a desired outlet flow directions.

The invention claimed is:

1. An outlet deflector unit for a pneumatic power tool with a housing having an air outlet passage with an outlet opening, the outlet deflector unit comprising:

a retaining socket having a collar;

a cup-shaped deflector element that is rotatably supported around an axial axis of the housing and axially sandwiched between a rear end of the housing and the collar of the retaining socket such that said deflector element is fixed in place and not translatable in a direction along said axial axis, said deflector element communicating with the outlet opening and having an axially directed curved banana-shaped opening and one radially directed opening, wherein said radially directed opening extends along a certain angular interval around a circumference of the deflector element, and wherein said axial axis extends in a longitudinal direction of the housing through a geometric center thereof; and a cup-shaped sector element arranged inside the deflector element and rotationally locked relative to the housing, said sector element having one radially directed side slot extending along a certain angular sector which is larger than said certain angular interval for said radially directed opening of the deflector element, and an axially directed curved banana-shaped outlet port extending over a second angular interval not covered by said certain angular sector and having substantially a same size as said axially directed curved banana-shaped opening of the deflector element, wherein said deflector element is rotatable to accomplish alignment either between said radially directed opening and said side slot of the sector element, or between said axially directed curved banana-shaped opening and the axially directed curved banana-shaped outlet port of the sector element, and wherein said certain angular sector extends over an angular interval substantially larger than the certain angular interval for the radially directed opening, thereby enabling a variation of a radial outlet flow direction within said certain angular interval without uncovering the axially directed curved banana-shaped outlet port.

2. The outlet deflector unit according to claim 1, wherein said radially directed side opening of the sector element extends over an angular sector that is substantially twice the size of the angular interval covered by said radial opening of the deflector element.

* * * * *